US006489713B1

(12) United States Patent
Mitrowitsch

(10) Patent No.: US 6,489,713 B1
(45) Date of Patent: Dec. 3, 2002

(54) COLOR PICTURE TUBE WITH A TENSION MASK

(75) Inventor: Johann Mitrowitsch, Lichtenwald (DE)

(73) Assignee: Matsushita Display Devices (Germany), GmbH, Esslingen (DE)

( * ) Notice: Subject to any disclaimer, the term of this patent is extended or adjusted under 35 U.S.C. 154(b) by 264 days.

(21) Appl. No.: 09/630,359

(22) Filed: Aug. 1, 2000

(30) Foreign Application Priority Data

Aug. 16, 1999 (DE) ..... 99116060

(51) Int. Cl.[7] ..... H01J 29/07
(52) U.S. Cl. ..... 313/407; 313/902
(58) Field of Search ..... 313/402, 403, 313/407; 445/30, 37

(56) References Cited

U.S. PATENT DOCUMENTS

| | | | | |
|---|---|---|---|---|
| 3,808,945 A | | 5/1974 | Roeder | |
| 4,942,332 A | | 7/1990 | Adler et al. | 313/402 |
| 5,554,909 A | * | 9/1996 | Brennesholtz | 313/402 |
| 5,610,473 A | | 3/1997 | Yokota et al. | 313/402 |
| 5,929,558 A | | 7/1999 | Lee | 313/402 |
| 6,106,353 A | * | 8/2000 | Kimura et al. | 445/30 |
| 6,420,823 B1 | * | 7/2002 | Tanaka | 313/402 |

FOREIGN PATENT DOCUMENTS

| | | | |
|---|---|---|---|
| EP | 0 372 630 | 6/1990 | H01J/29/07 |
| EP | 1 077 468 A1 * | 8/2001 | H01J/29/07 |
| JP | 56099949 | 10/1981 | H01J/29/07 |

* cited by examiner

*Primary Examiner*—Michael H. Day
(74) *Attorney, Agent, or Firm*—Boyle Fredrickson Newholm Stein & Gratz S.C.

(57) ABSTRACT

In the case of shadow masks which are pretensioned vertically and horizontally and the horizontal pretension of which is produced by stretching in the vertical direction, an expensive mask material having a low coefficient of thermal expansion can only be replaced by a less expensive mask material, such as iron, if the tension forces which can be produced for pretensioning the mask in the horizontal direction are markedly higher than the hitherto produced forces. For this purpose, the outer boundaries of the shadow-mask sides which are not connected to the mask frame are implemented such that they have a curved shape and a higher strength. In this way, it is possible to produce in a direction perpendicular to the stretching direction tension forces which are higher than the hitherto produced forces.

12 Claims, 4 Drawing Sheets

COLOR PICTURE TUBE WITH A TENSION MASK

BACKGROUND OF THE INVENTION

1. Field of the Invention

The present invention refers to a colour television set or a colour monitor and in particular a colour picture tube with a tension mask which is pretensioned in the vertical and in the horizontal direction.

2. Description of the Related Art

Colour television sets and (computer) monitors serve to convert electrical signals into colour pictures. Colour television sets and monitors have nowadays an interface for various video signal formats (such as e.g. composite colour picture signals, analog or digital component signals). These signals are converted into analog RGB signals for controlling a colour picture tube in a television set or in a monitor. The respective video signals fed to a television set or a monitor are converted in such way that each individual pixel of a reproduction screen can have associated therewith specific brightness and colour values. For reproducing a picture contained in a video signal, three electron beams are produced in a colour picture tube contained in a colour television set or a monitor. Each of these electron beams corresponds to one of the three primary colours of the additive colour mixture: red, green, blue. Depending on the reproduction position, the pixel information, i.e. the brightness and colour information, of the video signal is associated with a respective pixel on a luminescent screen of the colour picture tube.

By means of pixelwise superposition of three colour separation pictures, an additive colour mixture is obtained in the case of a colour picture tube. The luminescent screen of a colour picture tube contains approx. 400,000 colour triads, i.e. phosphor dots which are arranged in groups of three, each group comprising a red-light, a green-light and a blue-light phosphor dot. The diameter of such a phosphor dot is approx. 0.3 mm.

When a video signal is being reproduced, each of these dots is accessed by one of the three electron beams and caused to emit light. The electron beams are generated by an electron beam generation system in the neck of a colour picture tube. In FIG. 4, such a colour picture tube is shown in a cross-sectional view. A colour picture tube essentially consists of a glass element 15. On the inner side of the front screen 16 of the colour picture tube, a phosphor layer 17 comprising the phosphor dots is arranged. The electron beams for accessing the phosphor dots are produced by an electron gun 18 in the neck of the colour picture tube. The electric signals for controlling the electron gun are supplied to said electron gun from outside via contact pins 20. By means of a deflection unit which is not shown and which is arranged on the outer side of the colour picture tube, the electron beams are deflected in such a way that all the pixels of the luminescent screen are accessed successively. At a distance of approx. 15 mm from the luminescent screen 17, a shadow mask with a mask frame 19 is provided in the interior of the colour picture tube. In said shadow mask a separate aperture is associated with each colour triad on the luminescent screen. These apertures or holes have a diameter of approx. 0.25 mm and are etched into the shadow mask/hole mask at regular intervals. The three electron beams meet in the respective aperture accessed by the joint beam deflection and fall on the phosphor dots of the luminescent screen 17 located behind said aperture. In the course of this process, a major part of the electrons generated by the electron beam generation system land on the shadow mask. This causes warming and a corresponding thermal expansion of the shadow mask. As a result, the apertures in the shadow mask will change their position relative to the phosphor dots associated therewith. The colour purity of the pixels reproduced deteriorates due to this change of position. Such a deterioration becomes apparent especially with regard to the apertures located at the periphery of the mask.

Shadow masks are implemented not only in the form of aperture masks, but they are also used in the form of strip masks. In the case of these strip masks, the luminescent screen 17 of a colour picture tube is not provided with individual phosphor dots but with phosphor strips extending in the direction of the strips of the shadow mask. Accordingly, the shadow mask is provided with strip-shaped apertures for the individual electron beams, the respective strip-shaped apertures being associated with the strips on the luminescent screen. Such a strip mask often consists of "wires" that extend in parallel.

As can be seen in FIG. 4, the shadow mask is held by a mask frame 19 so as to impart mechanical stability to the mask and so as to make it easily handleable. Also the mask frame of modern colour picture tubes consists of a thin metal sheet.

In view of the small thermal expansion, shadow masks are nowadays also produced from iron-nickel alloys having a very small coefficient of thermal expansion. Since such iron-nickel alloys are many times more expensive than iron, mask frames are, however, produced from iron. The connection of shadow masks and mask frames consisting of materials with different coefficients of thermal expansion is problematic. When such mask/frame combinations become warm, deformations of the shadow mask may occur. This has the effect that the positions of the holes in the shadow mask change relative to the positions of the associated phosphor dots or phosphor strips.

The most widely used shadow masks are shaped, self-supporting shadow masks. Such a shadow mask is shown in FIG. 1. The shadow mask arranged behind the luminescent screen 1 comprises hole- or strip-shaped apertures 3 corresponding to the arrangement of the luminescent colours on the luminescent screen. The mask is secured to a frame 2. The contour of such a mask can be varied in the vertical as well as in the horizontal direction. The holding frame for the mask need not absorb any major forces in this case. The material of the frame can therefore be chosen substantially from the economical point of view.

Another type of colour picture tubes is pretensioned in the vertical direction. The major use of such shadow masks, so-called tension masks, is essentially in Trinitron tubes. These shadow masks are fixedly connected to the mask frame on the upper and lower boundaries thereof. The pretension of the shadow mask is necessary so as to guarantee that the distance between the luminescent screen and the shadow mask remains constant in the direction of the longitudinal axis 21 of the colour picture tube. Due to the pretension, the vertically oriented "wires" are held under tension. This imparts mechanical strength to the strip mask. The pretension necessitates high tension forces which may assume values of several kN. Hence, the mask frame must be very solidly built. Upon selecting the material, it is especially necessary to take into account the high process temperatures used in the production process of a colour picture tube. Such masks have, however, the advantage that they are highly transparent and that the mask contour has a high thermal stability. They are, however, disadvantageous insofar as they always have only a cylindrical curvature of the mask. In addition, the tight mask wires tend to react to mechanical vibrations with strong oscillations.

Such a tension mask with tension in the vertical direction is shown in FIG. 2. Also this mask is provided with a luminescent screen 1 and a mask frame 2. The wires 5 of the mask are pretensioned in the vertical direction. This pretension is indicated by the arrows 7, 8 in FIG. 2. In order to avoid oscillations of the wires and in order to keep the distances between the wires constant, so-called damping wires 6 are placed on top of the tight mask wires 5 such that they extend transversely thereto. These damping wires are provided for suppressing mechanical oscillations of the mask wires 5 and for keeping the distances between the individual wires constant. A disadvantage of these damping wires 6 is that they are imaged on the screen of the colour picture tube where they can be seen as permanently existing horizontal dark lines in the picture.

In the case of such vertically pretensioned masks, the mechanical stability can also be improved by arranging small crosspieces between the wires. These crosspieces prevent the individual mask wire from oscillating separately. By a uniform arrangement of such crosspieces, the distances between the wires are kept constant and a homogeneous, non-disturbing structure, which is also known from shaped shadow masks, is created on the screen.

The use of such crosspieces is, however, disadvantageous with regard to the mask wires insofar as the wires are coupled in the horizontal direction, and this has the effect that, in the case of thermal heating, the shadow mask will also expand in the horizontal direction. This kind of expansion will, in turn, cause a displacement of the points where the electron beams land on the luminescent screen. This displacement causes a deterioration of the image reproduction quality. To keep this effect small, Invar or other iron-nickel alloys having a small coefficient of thermal expansion are preferably used as a material for the shadow mask and the mask frame. This, however, will markedly increase the production costs of such a colour picture tube.

In order to avoid a deterioration of the image quality caused by a thermal expansion in the horizontal direction, one possibility is—as described—the use of special alloys as a mask material. Alternatively, it is, however, also possible to additionally apply a pretension to the mask in the horizontal direction. This will prevent the mask from curving in the longitudinal direction of the colour picture tube when the mask warms. FIG. 3 shows such a mask with a mask frame 2. The arrows 7–10 indicate that the mask is pretensioned both in the vertical and in the horizontal direction. In this way, it is also possible to compensate the consequences of a thermal expansion of the crosspieces between the holes 3 in the horizontal direction.

For producing such a horizontal pretension, the shadow mask is, in the most simple case, additionally also fixed to the mask frame on the sides. Alternatively, it is, however, also possible to produce a horizontal pretension without connecting the shadow mask to the lateral elements of the mask frame. For this purpose, the shadow mask is horizontally extended by a narrow, non-perforated portion. By stretching the shadow mask in the vertical direction, these non-perforated portions are extended in the direction of stretching. Simultaneously, a constriction occurs in the middle of these portions, i.e. these portions become narrower due to stretching, the narrowest point being in the middle. This has the effect that the perforated inner area of the shadow mask, which is located between the two non-perforated boundary portions, is drawn outwards. Hence, an additional horizontal pretension is produced simultaneously with the vertical pretension. This method is generally referred to as semi-stretch-tension technique, in short SST technique.

The principle underlying this technique is explained on the basis of FIG. 5. For this purpose, only part of the whole shadow mask is shown, the part of the shadow mask represented in FIG. 5 being only one half of said mask with one of the non-perforated, additional lateral areas. The shadow mask 25 has a perforated portion 26 and additional portions 27 having no holes provided therein. For producing the pretension in the vertical direction, the mask is vertically stretched before it is fixed to the mask frame. This has the effect that the shadow mask 25 will have applied thereto a permanent pretension in the vertical direction when it has been fixed to the mask frame. This pretension prevents the mask from curving in the direction of the longitudinal axis of the colour picture tube during operation due to thermal expansions in the vertical direction. In FIG. 5 it is shown how the shape of the non-perforated boundary portion 27 of the shadow mask changes during such stretching. The shape of the shadow mask prior to stretching is shown by the solid lines, the shape after stretching is represented by the broken line 30. During the stretching, the width of the boundary portion 27 is reduced, the maximum reduction of width being caused in the middle between the upper and the lower edge. The maximum reduction of width of the boundary portion 27 occurring in the course of this process is referred to as reduction of area/constriction C. Due to the fact that the boundary line 28 between the perforated portion and the non-perforated portion 27 is displaced by the reduction of area in the direction of the outer boundary 29 of the shadow mask 25, also the inner area 26 of the mask is drawn outwards. This has the effect that the perforated portion 26 is stretched in the horizontal direction, whereby a pretension is simultaneously produced in said horizontal direction.

In other words, stretching of the mask in the vertical direction will additionally cause an outwardly directed tension force in the horizontal direction. The magnitude of this tension force depends on the degree of the constriction C. The broader the portion 27 prior to vertical stretching, the larger the constriction C and therefore the horizontal tension force that can be produced. The width of the additional, non-perforated portions 27 can, however, be increased only to a very limited extent, without increasing the screen area in the horizontal direction by disturbing areas which cannot be used as a reproduction surface. Accordingly, the horizontal tension forces that can be produced are only very small.

By means of the horizontal tension forces that can nowadays be produced in this way, only the thermal expansions of mask materials having a particularly low coefficient of thermal expansion can be compensated for. Since these mask materials, such as Invar, are particularly expensive, it is desirable to replace such expensive mask materials by less expensive ones.

OBJECTS AND SUMMARY OF THE INVENTION

It is the object of the present invention to further develop known colour television sets and colour monitors and, in particular, colour picture tubes in such a way that the shadow masks of the colour picture tubes can also be produced from a less expensive mask material.

This object is achieved by the features of claim 1 for a colour picture tube, by the features of claim 8 for a colour television set and by the features of claim 9 for a colour monitor.

According to the present invention, an expensive mask material having a low coefficient of thermal expansion can be replaced by a less expensive mask material, such as iron, when the tension forces which can be produced in the horizontal direction are markedly higher than the hitherto produced forces, since this will offer the possibility of compensating also the much larger thermal expansions of the less expensive materials during operation. For this purpose, the shadow-mask sides which are not connected to the mask frame are implemented such that they have a curved shape, the curved outer boundary having a higher length than the inner area of the shadow mask. For producing an outwardly directed tension force which acts on the inner area of the shadow mask, the lateral boundaries must have an inwardly curved shape. When the mask is vertically stretched, the curved shape will be stretched as well, i.e. its curvature will decrease. This has the effect that all the points on the outer, reinforced boundary will move outwards and, consequently, also the inner area of the mask will move outwards in a corresponding manner. Also in the stretched condition of the shadow mask, the lateral outer boundaries maintain a curved shape, the curvature being, however, much smaller. The magnitude of the constriction in the middle of the shadow mask between the upper and the lower edge results from the curved shape (curvature) of the reinforced boundary before and after the stretching of the shadow mask. After the stretching, the outer, reinforced boundary of the shadow mask may assume an almost straight shape. In this way, a constriction can be achieved which will increase in proportion to the magnitude of the differences existing between the curved shapes before and after the vertical stretching of the shadow mask. Since the constriction that can be achieved in this way exceed those that can be produced in the case of conventional shadow masks, also the horizontal tension forces which can be produced in this way will be markedly stronger.

The shadow-mask expansion which can be compensated by means of these higher tension forces exceeds the horizontal expansion of the shadow mask which could normally be compensated up to now. This has the special advantage that the materials used for the shadow mask can also be materials which do not have a particularly low coefficient of thermal expansion, since, by means of the particularly high horizontal pretension according to the present invention, it is still possible to prevent the shadow mask from curving in the longitudinal direction of the picture tube. Hence, also less expensive materials, such as iron, can be used as a mask material without any deterioration of image quality in comparison with conventional masks. The production costs of colour picture tubes and consequently also of monitors and television sets can therefore be reduced whereas the quality will remain the same.

According to an advantageous embodiment, the shadow mask has a larger material cross-section at the curved sides thereof than in the inner area of the mask so as to reinforce said curved sides. In this way, the strength of the mask can be increased in a particularly simple manner.

When a shadow mask is being produced, the mask is normally subjected to an etching process for producing the apertures. During this etching process, the material cross-section of the whole mask is reduced. An increased material cross-section at the curved boundary areas to be reinforced can be produced in a particularly simple manner by leaving these boundary areas largely unetched during this process. This as the effect that, after the etching process, these portions will have a larger material cross-section than the perforated mask area.

An increase of the strength of the curved boundary areas can also be achieved by providing the shadow mask with a modified composition of materials in these areas. By modifying the composition of materials in the boundary areas, a higher strength can be achieved in said boundary areas. The increase in the cross-section of the mask can, in this way, be smaller or can be dispensed with completely in boundary areas.

The higher strength and the larger material cross-section, respectively, can also be achieved by providing an additional element in the boundary areas to be reinforced. This course of action is advantageous insofar as the masks can first be produced in the usual way and can then be combined with additional, separately produced elements in a final step. In this way, the present invention can easily be integrated into the usual sequence of production steps of a colour picture tube. When this additional element is produced from a material with increased strength, the material cross-section of this additional element can be particularly small.

It will be particularly advantageous when the shadow mask can be produced from iron.

BRIEF DESCRIPTION OF THE DRAWINGS

One embodiment of the present invention will be explained making reference to the drawing. The individual drawings show in FIG. 1 a shaped, self-supporting prior art shadow mask, appropriately labeled "PRIOR ART", FIG. 2 a prior art tension mask with tension in the vertical direction, appropriately labeled "PRIOR ART", FIG. 3 a prior art tension mask with tension in the horizontal and in the vertical direction, FIG. 4 the fundamental structural design of a prior art colour picture tube, appropriately labeled "PRIOR ART", FIG. 5 a horizontal extension portion of a prior art shadow mask in the stretched and in the unstretched condition, appropriately labeled "PRIOR ART", FIG. 6 a lateral boundary portion of a shadow mask in the stretched and in the unstretched condition, said lateral boundary portion being implemented according to the present invention, and in FIG. 7 the ratio between the curvatures of the lateral boundaries according to the present invention in dependence upon their thickness ratio.

DETAILED DESCRIPTION OF THE PREFERRED EMBODIMENTS

Figure 1:
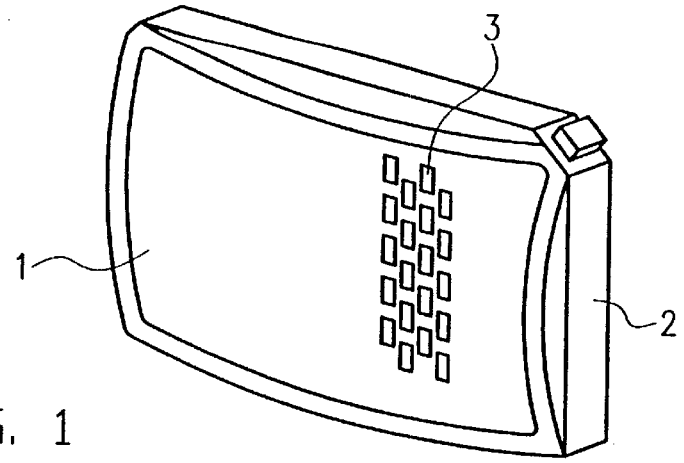
FIG. 1 PRIOR ART
Figure 2:
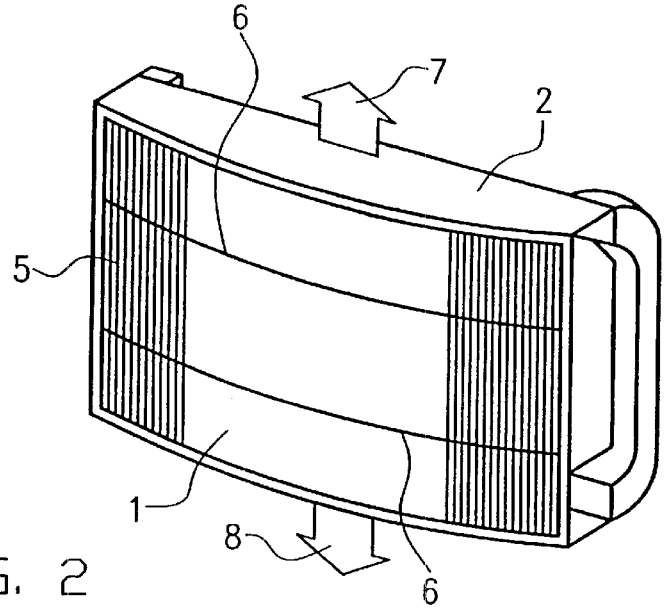
FIG. 2 PRIOR ART
Figure 3:
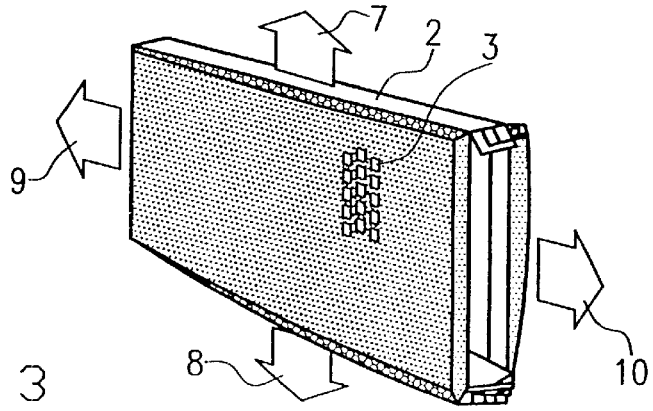
FIG. 3 PRIOR ART
Figure 4:
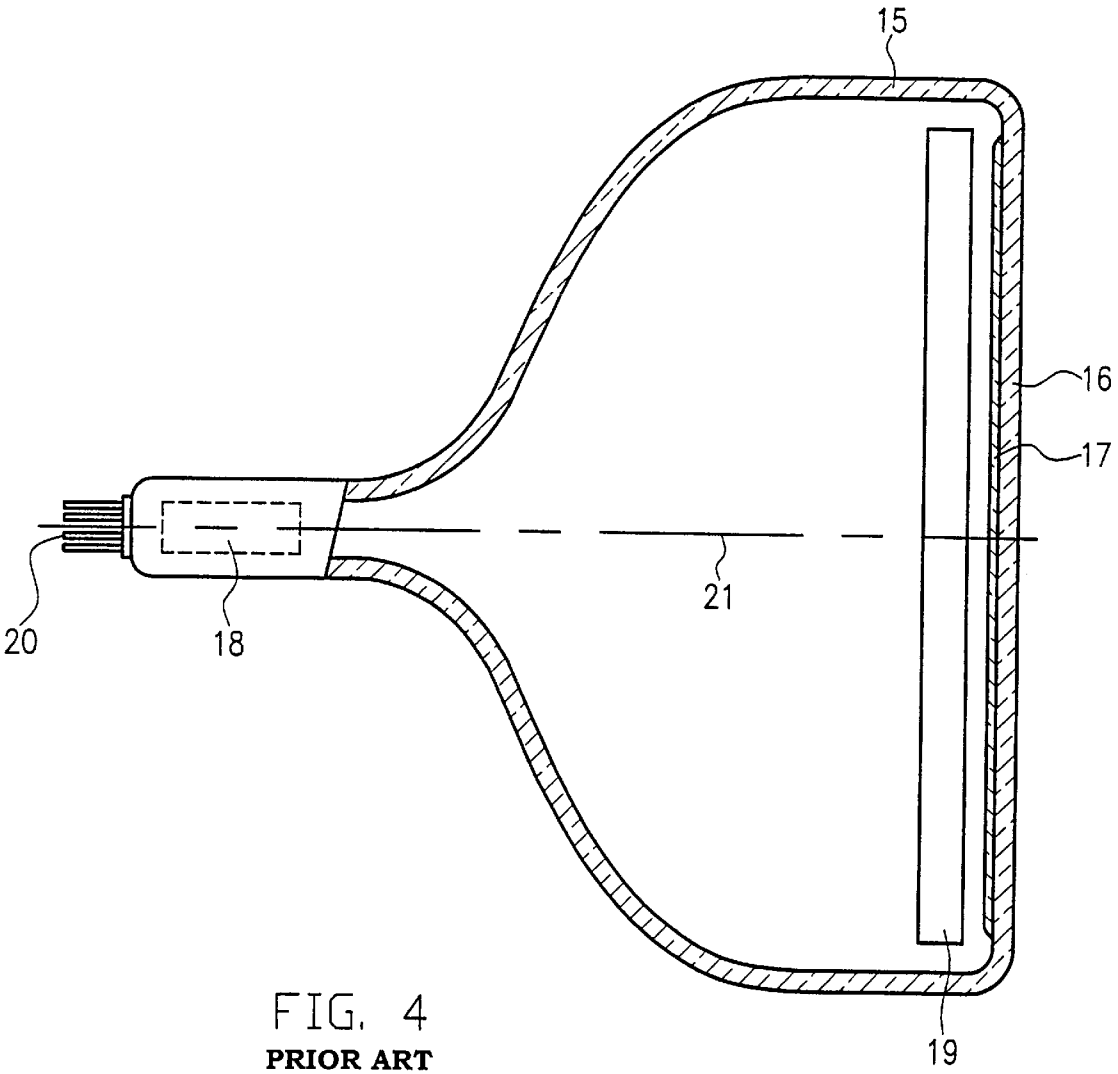
FIG. 4 PRIOR ART
Figure 6:
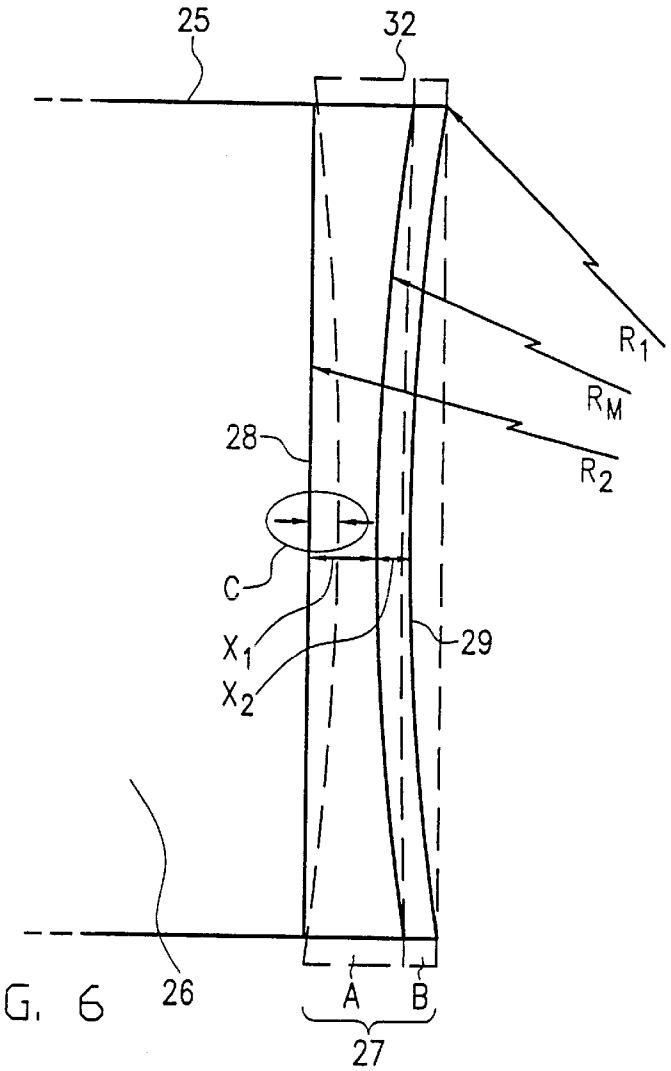

In FIG. 6 an embodiment of a shadow mask 25 implemented according to the present invention is shown. The shadow mask consists of a perforated portion 26 and a non-perforated portion 27. The portion 27 consists of two parts A and B having different structural designs. Part A corresponds with regard to its strength, and in particular with regard to its material cross-section, to the perforated/slotted portion 26 of the shadow mask, whereas part B is provided with a higher strength, e.g. by increasing its material cross-section. The cross-section of the part designated by A can be reduced by so-called etched-away portions to such an extent that it corresponds to the perforated/slotted mask portion 26 as far as its strength is concerned. The part designated by B is, however, implemented such that it has a markedly higher mechanical strength. Hence, said portion B can either be a so-called "solid material" without any etched-away portions or an additional material provided e.g. by affixing a further element.

Figure 5:
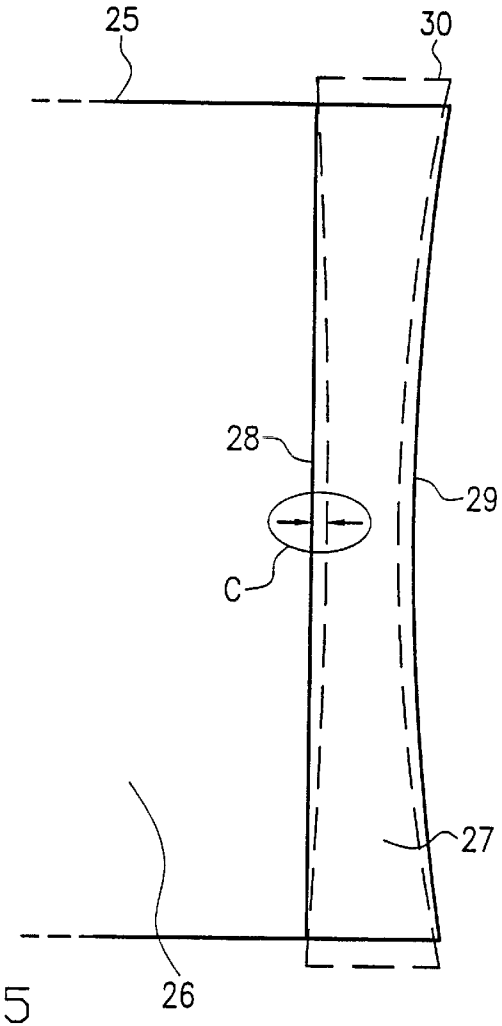
FIG. 5 PRIOR ART

The solid lines in FIG. 6 represent, like in FIG. 5, the condition of the shadow mask 25 prior to stretching in the vertical direction. The width of part A of the curved boundary is designated by $x_1$ in the middle between the upper and the lower edge of the shadow mask, the width of part B is designated by $x_2$. The inwardly directed radii of parts A and B of portion 27 are designated by $R_1$ for the outer edge of part B, $R_M$ for the central radius between parts A and B, and $R_2$ for the boundary line between part A and the perforated portion 26 of the shadow mask 25.

The condition of the boundary area 27 of the shadow mask 25 according to the present invention after stretching in the vertical direction is shown by the broken line in FIG. 6. The stretching has the effect that the curved shape of the reinforced part B is straightened. This means that, in comparison with the radii $R_1$ and $R_M$, the boundary lines of part B now only have a slight curvature which may even almost approach a straight line. The exact shape of a straight line can, however, not be achieved by such stretching so that the reinforced boundaries B will always have a "residual curvature" in the direction of the curved shape that existed prior to stretching.

Due to the stretching of the curved shape of the reinforced boundaries B, a constriction C is again produced. Other than in FIG. 5, the constriction of the portion 27 does in this case not take place on both sides of said portion 27, but only on the side of said portion 27 bordering on the perforated area 26 of the shadow mask. It follows that the reduction of area taking place in the case of the shadow mask according to the present invention is only a construction on one side so that the whole width reduction of said portion 27 will be of benefit to the production of the horizontal tension force. The stronger reduction of area can therefore cause a higher horizontal pretension of the shadow mask.

The maximum pretension that can be produced depends especially on the radii of the reinforced boundary areas B. The larger the difference between the radii before and after the vertical stretching of the shadow mask, the stronger the horizontal pretension that can be produced.

One embodiment for a colour picture tube according to the present invention, which is adapted to be installed in colour television sets and colour monitors according to the present invention, has approximately the following dimensions:

height of the shadow mask: approx. 414 mm, material of the shadow mask: iron, aspect ratio: approx. 4:3, thickness of the shadow mask: approx. 0.1 mm (with the exception of the reinforced boundary areas)

$x_1+x_2$: approx. 5 mm, $R_1$: approx. 3.35 m, $R_M$: approx. 12.0 m.

By means of such a colour picture tube, horizontal tension forces in the order of approx. 1000 N/mm$^2$ can be achieved. For the effects according to the present invention it is not necessary that the shadow mask of a colour picture tube has precisely these dimensions.

Similarly high horizontal tension forces can also be achieved by a shadow mask when the radius $R_1$ is smaller than approx. 4.5 m, in particular smaller than 4 m, and when the radius $R_M$ is smaller than 20 m, in particular smaller than 15 m, the rest of the shadow mask having the dimensions indicated hereinbefore. In the case of colour picture tubes having different dimensions also the parameters will have to be varied accordingly so as to obtain sufficiently high horizontal tension forces in each individual case.

As can be seen in FIG. 6, the constriction C that can be achieved in accordance with the present invention is markedly larger than the constriction achieved by hitherto known methods so that a stronger horizontal thermal expansion than usual can be compensated for. It is only this circumstance which permits the use of other mask materials in the case of shadow masks which are only fixed to the mask frame at two opposed sides, said mask materials being especially those which have a higher coefficient of thermal expansion. The comparatively expensive Invar used as a production material can be replaced by iron in this way. It is true that iron has a higher coefficient of thermal expansion, but the higher horizontal pretension according to the present invention can compensate the stronger thermal expansion of iron to such an extent that a curvature of the shadow mask in the longitudinal direction of the colour picture tube will not occur.

The reduction of area C that can be achieved (and, consequently, the horizontal tension force) depends not only on the radius of the reinforced outer lateral boundaries of the shadow mask but also on the degree of reinforcement of said boundaries. The reinforcement can be caused by increasing the material cross-section. The degree of reinforcement then results from the thickness ratio of the reinforced boundary to the non-reinforced part of the shadow mask. The horizontal tension force, which originates from the change of shape of the curved shape of the reinforced outer boundary B achieved by stretching, depends on the extent to which the stretching of the curved shape of the outer boundaries can stand up to the oppositely directed forces of the inner area of the mask. Also the inner area of the mask tries to compensate the stretching in the vertical direction by a contraction in the horizontal direction. The increase in the horizontally effective tension is achieved due to the fact that the strength of the outer boundary or rather of the two opposed outer boundaries is increased in such a way that these outer boundaries essentially force their change of shape on the inner area of the mask when vertical stretching takes place.

Figure 7:
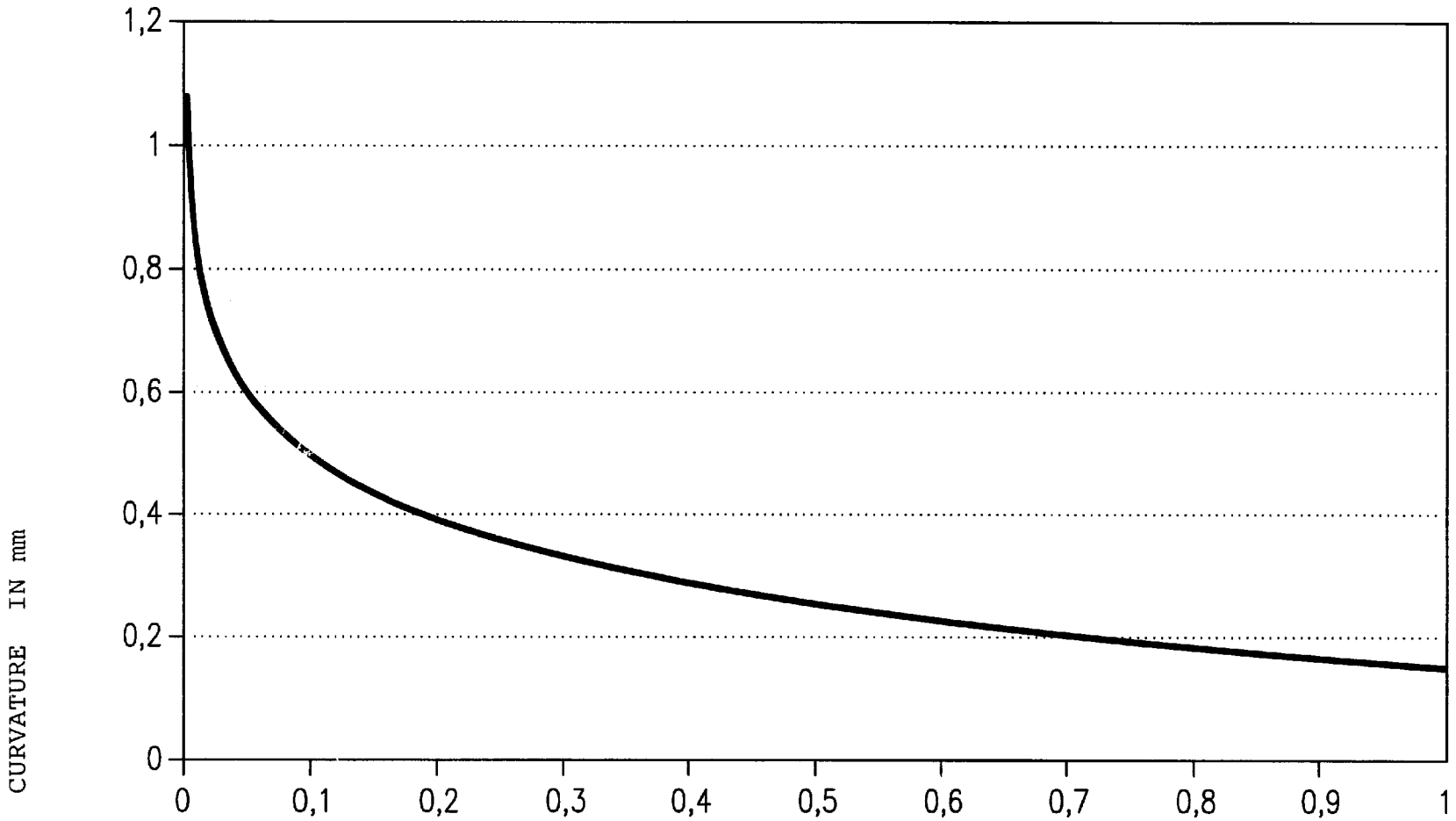

In FIG. 7 it is indicated how the curvature, i.e. the constriction C (in mm), can be varied in the case of the given parameters for the shadow mask by varying the thickness ratio of parts A and B. The obtainable curvature and, consequently, the obtainable horizontal tension force increases markedly as the thickness differences between part A and part B increase, i.e. as the material cross-section of part B increases, whereas the thickness of part A remains the same. For example, when the thickness ratio of A to B is approx. 0.7 in the case of a shadow mask having the above-mentioned parameters, a curvature of 0.2 mm can be achieved. When the thickness ratio of A to B is 0.2, a curvature which is twice as large, viz. approx. 0.4 mm, can be achieved.

The present invention fundamentally aims at increasing a second pretension, which is produced indirectly via a first pretension. The second pretension is produced in a direction which extends essentially at right angles to the direction of the first pretension. Due to an inwardly directed curved shape of the lateral mask boundaries and due to the reinforcement of said boundaries, the obtainable second pretension can be increased markedly.

What is claimed is:

1. A colour picture tube comprising a shadow mask having a substantially rectangular shape and a mask frame supporting said shadow mask, wherein the shadow mask is pretensioned in two directions extending essentially at right angles to one another, the shadow mask is fixed in the mask frame at two opposed sides thereof and the two other sides of the shadow mask are not connected to said mask frame, and wherein the outer boundaries of the shadow-mask sides which are not connected to the mask frame are reinforced in strength in comparison with the inner area of the shadow mask and have a shape which is curved towards the interior of the shadow mask.

2. A colour picture tube according to claim 1, wherein the reinforcement of the strength of the outer boundaries of the curved sides of the shadow mask is achieved by an increase in the material cross-section.

3. A colour picture tube according to claim 2, wherein the boundaries of the shadow mask are reinforced in that the material cross-section of the boundaries is not reduced by etching during production of the mask.

4. A colour picture tube according to claim 2, wherein the boundaries of the shadow mask are reinforced in that the strength is increased by a modified composition of the mask material at the outer boundaries.

5. A colour picture tube according to claim 2, wherein the boundaries of the shadow mask are reinforced in that additional elements are arranged in the boundary areas.

6. A colour picture tube according to claim 1, wherein the boundaries of the shadow mask are reinforced in that the strength is increased by a modified composition of the mask material at the outer boundaries.

7. A colour picture tube according to claim 6, wherein the boundaries of the shadow mask are reinforced in that additional elements are arranged in the boundary areas.

8. A colour picture tube according to claim 1, wherein the boundaries of the shadow mask are reinforced in that additional elements are arranged in the boundary areas.

9. A colour picture tube according to claim 6, wherein these additional elements consist of a material having a higher strength.

10. A colour picture tube according to 1, wherein the shadow mask is produced from iron.

11. A colour television set comprising a colour picture tube according to claim 1.

12. A colour monitor comprising a colour picture tube according to claim 1.

* * * * *